US005405524A

United States Patent [19]

Sharma et al.

[11] Patent Number: 5,405,524

[45] Date of Patent: Apr. 11, 1995

[54] PROCESS FOR THE CATALYTIC CONVERSION OF LOW MOLECULAR WEIGHT AROMATIC HYDROCARBONS

[75] Inventors: Raj K. Sharma; Dusan C. Prevorsek, both of Morristown, N.J.

[73] Assignee: AlliedSignal Inc., Morristown, N.J.

[21] Appl. No.: 145,361

[22] Filed: Oct. 29, 1993

[51] Int. Cl.[6] ..... C10C 3/02

[52] U.S. Cl. ..... 208/40; 208/44; 208/22

[58] Field of Search ..... 208/4, 22, 40, 44

[56] References Cited

U.S. PATENT DOCUMENTS

| | | | |
|---|---|---|---|
| 4,431,513 | 2/1984 | Lewis | 208/44 |
| 4,789,455 | 12/1988 | Mochida et al. | 208/44 |
| 4,986,893 | 1/1991 | Seo et al. | 208/44 |

FOREIGN PATENT DOCUMENTS

| | | | |
|---|---|---|---|
| 531202 | 10/1958 | Canada | 208/40 |
| 1001976 | 12/1976 | Canada . | |
| 1243973 | 11/1988 | Canada . | |
| 0090475 | 10/1983 | European Pat. Off. | 208/40 |

*Primary Examiner*—Asok Pal
*Assistant Examiner*—Walter D. Griffin
*Attorney, Agent, or Firm*—Colleen D. Szuch; Jay P. Friedenson

[57] ABSTRACT

The process of the invention comprises:

a) heating at least one low molecular weight aromatic hydrocarbon in the presence of a Lewis acid under conditions sufficient to produce a pitch of desired composition and properties;

b) recovering a pitch of desired composition and properties.

The process of the invention may be used to produce pitch which can be used in roofing and binder applications.

25 Claims, No Drawings

PROCESS FOR THE CATALYTIC CONVERSION OF LOW MOLECULAR WEIGHT AROMATIC HYDROCARBONS

Coal tar is a syrupy substance obtained during the production of coke in coke ovens. This material may be fractionated to produce coal tar pitch, a complex mixture of many organic compounds most of which contain from 3 to 6 rings and boil in the range of about 350°–550° C. The precise composition and properties of the coal tar pitch vary according to the source of the coal tar and the method of removing the low molecular weight species from the coal tar. A typical coal tar pitch has the following composition: 92%C, 4.5%H, 1.7%O, 0.9%N and 0.4%S.

The applications in which coal tar pitch can be utilized will depend on its composition and properties (e.g., softening point). Typically, pitch having a softening point of about 50°–66° C. can be used in roofing applications. In this application, the pitch is used as a water proofing agent. Pitch having a softening point of about 110°–120° C. and quinoline and toluene insolubility limits of 10–20 wt % and >30 wt % respectively may be used in binder applications for the manufacture of high purity carbon anodes for the aluminum industry. The carbon anode consists of a filler (calcined petroleum coke) and binder (pitch) which forms the bond between the filler particles.

Besides pitch, fractionation of coal tar yields low molecular weight hydrocarbons called creosote oils. These oils are generally aromatic and have boiling points of up to about 300° C. The distribution between pitch and these low molecular weight oils is about 50:50. Unlike pitch, these creosote compounds have very limited commercial application. Creosote compounds have been used as fuel to a limited extent. Because this material is produced in great quantity and has limited utility, the bulk of creosote produced must be disposed. This is quite costly and may contaminate the environment.

Various processes for the conversion of high molecular weight aromatic hydrocarbons like coal tar are known in the art. See Canadian Patent 1,001,976 which discloses the conversion of heavy oils (boil over 300° C.) to coal tar pitches by reaction in a pressure vessel. Canadian Patent 1,243,973 ('973 patent) teaches the conversion of a mixture of petroleum and coal tar distillates boiling above 330° C. to pitches with high aromaticity by refluxing in the presence of a Lewis acid added in at least two steps. These processes both require an extra step to remove low molecular weight compounds which is costly. The '973 patent also utilizes high temperature and pressure which makes this process even less economical.

DESCRIPTION OF THE INVENTION

We have developed a cost effective method of converting low molecular weight aromatic hydrocarbons such as coal tar distillates like creosote oil to pitch and which eliminates the cost and potential contamination problems associated with its disposal.

The process comprises:

a) heating at least one low molecular weight aromatic hydrocarbon in the presence of a Lewis acid under conditions sufficient to produce a pitch of desired composition and properties;

b) recovering a pitch of desired composition and properties.

In a preferred embodiment, the process comprises:

a) heating at least one coal tar distillate which has a boiling point of less than about 300° C. in the presence of a Lewis acid which sublimes to a temperature of at least about 150° C. but not at or above the sublimation temperature of said Lewis acid under conditions sufficient to produce a a mixture containing a pitch of desired composition and properties;

b) heating the mixture of step a) above the sublimation temperature of said Lewis acid but below about 350° C. under conditions sufficient to produce a pitch of desired composition and properties; and c) recovering a pitch of desired composition and properties.

In a more preferred embodiment, the process comprises:

a) heating at least one coal tar distillate which has a boiling point of less than about 300° C. in the presence of a Lewis acid which sublimes to a temperature of at least about 150° C. but not at or above the sublimation temperature of said Lewis acid in an atmosphere of air or an inert gas under conditions sufficient to produce a mixture containing a pitch of desired composition and properties;

b) heating the mixture of step a) above the sublimation temperature of said Lewis acid but below about 350° C. under conditions sufficient to produce a pitch of desired composition and properties; and c) recovering a pitch of desired composition and properties.

In another embodiment, the process comprises:

a) heating at least one coal tar distillate which has a boiling point of less than about 300° C. in the presence of a Lewis acid which sublimes to a temperature of at least about 150° C. but not at or above the sublimation temperature of said Lewis acid, in an atmosphere of air or an inert gas under conditions sufficient to produce a mixture containing a pitch of desired composition and properties;

b) heating the mixture of step a) above the sublimation temperature of said Lewis acid but below about 350° C.;

c) collecting the sublimed Lewis acid;

4 recycling said Lewis acid to step 1; and 5 recovering a pitch.

For purposes of this invention, low molecular weight aromatic hydrocarbon shall mean an aromatic hydrocarbon having from 1 to 3 rings which may be substituted, has a molecular weight of about 100–180 and has a boiling point of from about 175°–300° C. These low molecular weight aromatic hydrocarbons include both petroleum and coal tar distillates.

Coal tar and petroleum distillates are generally 2 to 3 ringed aromatic hydrocarbons which may be substituted. They have an average molecular weight of about 130, a density of about 1.04–1.18g/cc, a vapor pressure of about 370 mm Hg at 150° C. and leave a residue of about 70% at 355° C. For example, coal tar distillates or creosote compounds (with boiling points less than about 300° C.) include, but are not limited to, the following compounds including mixtures thereof:

| | Formula | Boiling Point (°C.) |
|---|---|---|
| Coumarone | $C_8H_6O$ | 174 |
| p-Cymene | $C_{10}H_{14}$ | 177 |
| Indene | $C_9H_8$ | 182 |
| Phenol | $C_6H_6O$ | 181 |
| O-Cresol | $C_7H_8O$ | 190 |
| Benzonitrile | $C_7H_5N$ | 191 |
| m-Cresol | $C_7H_8O$ | 202 |
| Naphthalene | $C_{10}H_8$ | 218 |
| Thionaphthene | $C_8H_6S$ | 222 |
| Quinoline | $C_9H_7N$ | 243 |
| 2-Methylnaphthalene | $C_{11}H_{10}$ | 241 |
| Isoquinoline | $C_9H_7N$ | 238 |
| 1-Methylnaphthalene | $C_{11}H_{10}$ | 245 |
| 4-Indanol | $C_9H_{10}O$ | 245 |
| 2-Methylquinoline | $C_{10}H_9N$ | 247 |
| Indole | $C_8H_7N$ | 252 |
| Diphenyl | $C_{12}H_{10}$ | 255 |
| 1,6-Dimethyinaphthalene | $C_{12}H_{12}$ | 262 |
| 2,3-Dimethylnaphthalene | $C_{12}H_{12}$ | 266 |
| Acenaphthene | $C_{12}H_{10}$ | 281 |
| Dibenzofuran | $C_{12}H_{10}O$ | 287 |
| Fluorene | $C_{13}H_{10}$ | 299 |

Petroleum and coal tar distillates (or creosote compounds including those with boiling points less than about 300° C.) may be obtained by fractionating crude oil and coal tar respectively by any means well known in the art. See, e.g., B. Rand, Handbook of Composites, vol. 1, Ch XIII, (1985) and Canadian Patent 1,243,973. Coal tar distillates including those with boiling points less than about 300° C. may be purchased from Allied-Signal Inc. at it's Ironton, Ohio and Detroit, Mich. facilities.

The composition and properties of the pitch produced by the process of the invention will depend on the reaction conditions and starting material (i.e., type of low molecular weight aromatic hydrocarbon). The pitch is generally a mixture of many organic compounds most of which contain 3 to 6 rings, have a softening point of about 30°-220° C. and a density of about 1.24–1.35g/cc at 25° C. Preferably, the pitch has a softening point of about 50°-120° C., a density of about 1.26–1.3 lg/cc, a toluene insolubility of less than about 50 wt % and a quinoline insolubility of less than about 12 wt. %. More preferably, the pitch has a softening point of about 50°-66° C. and a density of about 1.24g/cc at 25° C. or a softening point of about 110°-120° C., a density of about 1.3 lg/cc at 25° C. and a quinoline and toluene insolubility of 10°-20wt % and >30 wt. % respectively.

Any Lewis acid may be employed as catalyst in the process. A Lewis acid is defined as a substance that can accept a pair of electrons from a donor substance, the base, and form a covalent bond with it. See, e.g., W. J. Moore, Physical Chemistry, 2nd Ed., 470 (1955). Lewis acids which sublime are preferred because they simplify or eliminate a catalyst recovery step as discussed more fully below. Those Lewis acids which sublime include $AlCl_3$which has a sublimation temperature of 180.2° C. Kirk Othmer, Encyclopedia of Chemical Technology, 4th Ed. Vol. 2, 282 (1992). When $AlCl_3$ is used as the catalyst, it is the anhydrous form not the hydrate which is the Lewis acid and which may be used in the invention. The term anhydrous in this context shall mean that it contains less than about 0.2 wt % H2O and preferably about 0 wt % $H_2O$. Other Lewis acids include zinc chloride and ferric chloride.

We have discovered that conversion of low molecular weight aromatic hydrocarbons is optimized when the catalyst purity is high i.e., greater than 99 wt %, preferably greater than 99.5 wt % and more preferably greater than 99.9 wt %. Compare the viscosities in Examples 9 and 10 and 11 and 12 in Table I below. The higher the viscosity the greater the conversion (polymerization).

Catalyst concentration ( wt % catalyst to low molecular weight aromatic hydrocarbon (starting material)) also affects conversion. Generally, the greater the concentration, the higher the conversion. Compare the viscosities of Examples 1 and 3 and Examples 4 and 5 in Table I and Examples 22 and 23 in Table II. Preferably, the concentration is from about 2°-10wt %. It is more preferable that the concentration is from about 5-10wt % and most preferable from about 7-10wt %.

The reaction conditions such as temperature and time will depend on the Lewis acid selected, the type of low molecular weight aromatic hydrocarbon being converted and the type of pitch desired. For example, when $AlCl_3$ is the Lewis acid and coal tar distillates are being converted, the reaction is preferably conducted at from about 150°-179° C., and preferably from about 170°-179° C. for about 1-6 hours and preferably from about 2-4 hours. See Examples 13-15 below.

The reaction may be conducted in air[1], nitrogen or in an inert gas like helium or argon. This is useful because the purging gas carries away unreacted low molecular weight materials and the sublimed catalyst from the reaction product. Inert gases are preferred because they eliminate oxidation of pitch at higher temperatures like 350° C. during the reaction.[2] Of the gases tested, argon appears to produce the highest conversion of low molecular weight hydrocarbons. Compare viscosities of Examples 6-8.

[1]Air typically has a composition of: 78%N 21%0 0.03%$CO_2$ 0.9%Ar

[2]Mild oxidation (i.e., up to about 250° C.) may be beneficial as it induces dehydrogenative polymerization of aromatic molecules thus helping to increase the softening point and molecular weight.

Pressure is not critical. However, we have discovered that higher pressures (i.e., up to about 75 psia) promote the reaction. Compare the increase in viscosity between Examples 20 and 21. Preferably, the reaction is conducted at a pressure of from about 15-75 psia and more preferably from about 40-75psia.

The temperature at which post reaction heating (step 2) is conducted will also depend on the catalyst used. For example, when the Lewis acid used will sublime, the post reaction temperature is preferably above the sublimation temperature of the Lewis acid and less than about 350° C. Heating to above 350° C. will result in degradation of the product. When $AlCl_3$ is the Lewis acid, the post reaction temperature is preferably from about 300°-350° C. and more preferably about 350° C..

When post reaction heating is used, the mixture of step 1 is preferably heated post reaction for a period of from about 1-12 hours, more preferably from about 2-6 hours. Generally, the higher the temperature and longer the post reaction period, the greater the polymerization or conversion to high molecular weight aromatic hydrocarbons as shown by the dramatic increase in viscosity of the resulting product. See Examples 16-19 below.

The apparatus used in the reaction can be fitted with a cold trap which contains a trapping fluid. Volatiles such as very low molecular weight aromatic hydrocarbons which did not convert and the sublimed catalyst will collect here. Creosote oil is the preferred trapping fluid as it and the compounds trapped in it may be used as reactants in a subsequent conversion reaction.

The catalyst collected in the cold trap containing the unconverted hydrocarbons does not need to be separated from the hydrocarbons. The concentration of the catalyst may be determined by any means known in the art and adjusted if necessary. Then, as discussed above, this mixture of catalyst and hydrocarbon can be used in a subsequent conversion. This eliminates the need to purify and/or regenerate the catalyst.

The pitch can be recovered after the Lewis acid and volatiles (unconverted very low molecular weight aromatic hydrocarbons) have been collected. The pitch is the remaining black residue.

EXAMPLES 1-24

A series of experiments was conducted to determine the effect of various variables like catalyst concentration and purity, reaction atmosphere, temperature and pressure and post reaction temperature and time on the conversion of heavy creosote oil[3] and light creosote oil[4] to pitch. The results are reported in Tables I and II respectively.

[3]The heavy creosote oil used in Examples 1-21 was a mixture of 1 to 3 ringed aromatic hydrocarbons some of which were substituted, having an average molecular weight of about 130, a density of abut 1.04-1.18 g/cc, a vapor pressure of about 370 mm Hg at 150° C. and which left a residue of about 70% at 355° C.

[4]The light creosote oil used in Examples 22-24 was a mixture of 1 to 3 ringed aromatic hydrocarbons some of which were substituted, having an average molecular weight of about 110, a density of about 1.01-1.10 g/cc, a vapor pressure of about 400 mm Hg at 150° C. and which left a residue of about 40% at 355° C.

Experiments conducted at atmospheric pressure utilized a Lindberg Box Furnace Model #51442 consisting of a 1200° C. box furnace, a retort and a programmable temperature control. Prior to use, the interior of the retort was calibrated for temperature. The atmosphere in which the reaction was conducted was controlled using the retort. In a typical experiment, a covered porcelain or quartz crucible containing 15-20 g of coal tar distillate and the required amount of catalyst (reported in the Tables) was placed in the retort at room temperature. The retort was then purged with argon at one atmosphere for half an hour to expel any oxygen from the system. The temperature was raised 10° C./minute until the desired reaction temperature was reached and then the temperature was maintained for the desired reaction time.

Post reaction heating was conducted in the same furnace without removing the sample container after reaction. The temperature was raised 10° C./minute until the desired temperature was reached and then maintained for the desired post reaction period. At the end of the experiment, heating was discontinued and the sample allowed to cool to room temperature. From the time the sample was placed in the furnace until it was cooled argon gas at one atmosphere pressure was passed through the retort at about 20cc/minute. The volatiles emitted during the process were carried away by the purging argon gas through the exit pipe of the furnace and into in a cold trap containing creosote oil. The furnace was allowed to cool to room temperature after the reaction. The crucible containing the solid residue (pitch) was removed and weighed to determine yield. As used in the Tables, Char Yield shall mean the percent residue left when the pitch is heated, in helium, from room temperature to 1000° C. at the rate of 10° C. per minute and held at 1000° C. for 1 hour.

TABLE I

| | | Treatment Cycle | | | | | | | | |
|---|---|---|---|---|---|---|---|---|---|---|
| | | Reaction | Post Reaction | $AlCl_3$ | | | | | | Softening |
| Example | Variables | Temp/Time (°C.)/(Hour) | Temp/Time (°C.)/(Hour) | Conc. (%) | Purity (%) | Gas | Yield (%) | Viscosity cp @ 80° C. | Char Yield | Point (°F.) |
| 1 | $AlCl_3$ | 175/2 | 300/2 | 10.3 | 99.9 | Ar | 91.8 | 131000* | 31.6 | 191 |
| 2 | Concentration | 175/2 | 300/4 | 7.7 | 99.9 | Ar | 86.7 | 4510 | 21.6 | |
| 3 | | 175/2 | 300/2 | 5.2 | 99.9 | Ar | 91.3 | 70 | 4.8 | |
| 4 | | 175/6 | 350/2 | 2.6 | 99.9 | Ar | 61.0 | 4246 | 12 | |
| 5 | | 175/6 | 350/2 | 5.2 | 99.9 | Ar | 70.0 | 6500 | 13.73 | |
| 6 | Atmosphere | 175/2 | 350/2 | 5.2 | 99.9 | Ar | 62.0 | 5880 | | |
| 7 | | 175/2 | 350/2 | 5.2 | 99.9 | Air | 64.7 | 3199 | | |
| 8 | | 175/2 | 350/2 | 5.2 | 99.9 | N2 | 63.0 | 2865 | | |
| 9 | $AlCl_3$ Purity | 175/2 | 350/2 | 5.2 | 99.9 | Ar | 62.0 | 5880 | | |
| 10 | | 175/2 | 350/2 | 5.2 | 98.0 | Ar | 63.4 | 2350 | | |
| 11 | | 175/6 | 350/2 | 5.2 | 98.0 | Ar | 60.9 | 1247 | | |
| 12 | | 175/6 | 350/2 | 5.2 | 99.9 | Ar | 70.1 | 6500 | 13.73 | |
| 13 | Reaction | 150/2 | 300/2 | 5.2 | 99.9 | Ar | 87.6 | 89 | | |
| 14 | Temperature | 175/2 | 300/2 | 5.2 | 99.9 | Ar | 91.3 | 70 | | |
| 15 | | 200/2 | 300/2 | 5.2 | 99.9 | Ar | 88.2 | 152 | | |
| 16 | Post Reaction | 175/2 | 350/2 | 5.2 | 99.9 | Ar | 62.0 | 5880 | | |
| 17 | Temperature | 175/2 | 300/2 | 5.2 | 99.9 | Ar | 91.3 | 70 | | |
| 18 | Post Reaction | 175/2 | 350/6 | 5.2 | 99.9 | Ar | 55 | 24200 | 22.6 | 142 |
| 19 | Time, hrs | 175/2 | 350/2 | 5.2 | 99.9 | Ar | 62 | 5880 | | |
| 20 | Pressure, Psig | 175/2 0 | 300/2 | 5.2 | 99.9 | Ar | 91.3 | 70 | | |
| 21 | | 175/2 55 | 300/2 | 5.2 | 99.9 | Ar | 57.2 | 13060 | 19.6 | 122 |

TABLE II

| | | Treatment Cycle | | | | | | | | |
|---|---|---|---|---|---|---|---|---|---|---|
| | | Reaction | Post Reaction | $AlCl_3$ | | | | | | Softening |
| Example | Variables | Temp/Time (°C.)/(Hour) | Temp/Time (°C.)/(Hour) | Conc. (%) | Purity (%) | Gas | Yield (%) | Viscosity cp @ 80° C. | Char Yield | Point (°F.) |
| 22 | $AlCl_3$ | 175/2 | 350/2 | 5.2 | 99.9 | Ar | 46.2 | 265,000 | 30.96 | 154 |
| 23 | Concentration | 175/2 | 350/2 | 2.6 | 99.9 | Ar | 32.1 | 136,000 | | |
| 24 | | 175/6 | 350/2 | 2.6 | 99.9 | Ar | 42.6 | 60,000 | | |

Comparison of the Examples conducted under similar conditions with heavy creosote oil and light creosote oil show that even higher conversions are obtained with light creosote oil. This may be due to the higher concentration of lower molecular weight aromatics in the light creosote oil which are more prone to polymerize.

We claim:

1. A process comprising:

a) heating at least one low molecular weight aromatic hydrocarbon which has a boiling point of less than about 300° C., in the presence of a Lewis acid which sublimes, to a temperature of at least about 150° C. but not at or above the sublimation temperature of said Lewis acid under conditions sufficient to produce a mixture containing a pitch of desired composition and properties;

b) heating the mixture containing pitch and Lewis acid of step a) above the sublimation temperature of said Lewis acid but below about 350° C. under conditions sufficient to produce a mixture containing a pitch of desired composition and properties; and c) recovering a pitch of desired composition and properties.

2. A process comprising:

a) heating at least one coal tar distillate which has a boiling point of less than about 300° C. in the presence of a Lewis acid which sublimes to a temperature of at least about 150° C. but not at or above the sublimation temperature of said Lewis acid under conditions sufficient to produce a mixture containing a pitch of desired composition and properties;

b) heating the mixture containing pitch and Lewis acid of step a) above the sublimation temperature of said Lewis acid but below about 350° C. under conditions sufficient to produce a mixture containing a pitch of desired composition and properties; and c) recovering a pitch of desired composition and properties.

3. The process of claim 1 wherein the reaction is conducted in an atmosphere of air, nitrogen or an inert gas.

4. The process of claim 2 wherein the reaction is conducted in an atmosphere of air, nitrogen or an inert gas.

5. The process of claim 1 wherein said Lewis acid is selected from the group consisting of aluminum (III) chloride, zinc chloride, and ferric chloride.

6. The process of claim 5 wherein said Lewis acid is aluminum (III) chloride.

7. The process of claim 4 wherein said Lewis acid is selected from the group consisting of aluminum (III) chloride, zinc chloride, and ferric chloride.

8. The process of claim 7 wherein said Lewis acid is aluminum (III) chloride.

9. The process of claim 6 wherein said aluminum (III) chloride has a purity of greater than 99.5 weight percent.

10. The process of claim 8 wherein said aluminum (III) chloride has a purity of greater than 99.5 weight percent.

11. The process of claim 9 wherein said aluminum (III) chloride has a concentration of from about 2 to about 10 weight percent.

12. The process of claim 10 wherein said aluminum (III) chloride has a concentration of from about 7 to about 10 weight percent.

13. The process of claim 11 whereto said heating in step a is conducted at a temperature of from about 150° C. to about 179° C.

14. The process of claim 13 wherein said heating in step a is conducted at a temperature of from about 170° C. to about 179° C.

15. The process of claim 12 wherein said heating in step a is conducted at a temperature of from about 170° C. to about 179° C.

16. The process of claim 15 wherein said heating in step b is conducted at a temperature of above 180.2° C. and less than about 350° C.

17. The process of claim 16 wherein said heating in step b is conducted at a temperature of about 350° C.

18. The process of claim 1 further comprising collecting a mixture of the Lewis acid and at least one unconverted low molecular weight aromatic hydrocarbon.

19. The process of claim 17 further comprising collecting a mixture of the sublimed Lewis acid and at least one unconverted coal tar distillate.

20. The process of claim 18 wherein said Lewis acid/unconverted low molecular weight aromatic hydrocarbon mixture is recycled to step a).

21. The process of claim 19 wherein said sublimed Lewis acid/unconverted coal tar distillate mixture is recycled to step a).

22. The process of claim 1 wherein said low molecular weight aromatic hydrocarbon has a molecular weight of at least about 94.

23. The process of claim 1 wherein said low molecular weight aromatic hydrocarbon has a molecular weight of at least about 103.

24. The process of claim 1 wherein said low molecular weight aromatic hydrocarbon has a molecular weight of at least about 117.

25. The process of claim 1 wherein said low molecular weight aromatic hydrocarbon has a molecular weight of at least about 128.

* * * * *